United States Patent [19]

Moriya et al.

[11] Patent Number: 4,795,285

[45] Date of Patent: Jan. 3, 1989

[54] TOOTHED BELT AND SPLIT PIN CARRIAGE DRIVE

[75] Inventors: Mikio Moriya, Tokorosawa; Junichi Furukawa, Tokyo; Makoto Kawasaki, Tokorosawa; Tsutomu Iesaka, Sayama, all of Japan

[73] Assignee: Citizen Watch Co. Ltd., Tokyo, Japan

[21] Appl. No.: 122,236

[22] Filed: Nov. 17, 1987

[30] Foreign Application Priority Data

Nov. 17, 1986 [JP] Japan ..... 61-175340[U]
Jun. 16, 1987 [JP] Japan ..... 62-91382[U]
Jun. 16, 1987 [JP] Japan ..... 62-91383[U]

[51] Int. Cl.[4] ..... B41J 19/20
[52] U.S. Cl. ..... 400/320; 400/335
[58] Field of Search ..... 400/320, 323, 328, 335

[56] References Cited

U.S. PATENT DOCUMENTS 3,476,044 11/1969 Wassermann ..... 400/320 X
4,084,681 4/1978 Heinzl et al. ..... 400/320
4,372,698 2/1983 Matsushima ..... 400/320

FOREIGN PATENT DOCUMENTS 49-19730 2/1974 Japan .
83484 5/1982 Japan ..... 400/320
61-78639 5/1986 Japan .

*Primary Examiner*—Clifford D. Crowder
*Attorney, Agent, or Firm*—Wenderoth, Lind & Ponack

[57] ABSTRACT

A toothed belt and pin assembly for a printer in which the pin is engaged with a guide hole of a carriage for reciprocally driving the carriage during movement of the belt. The assembly has an endless belt having a pitch line, and a pin mounted on the belt with the axis of the pin coinciding with the pitch line of the belt.

4 Claims, 5 Drawing Sheets

TOOTHED BELT AND SPLIT PIN CARRIAGE DRIVE

FIELD OF THE INVENTION

The present invention relates to a toothed belt for a printer and more particularly to a toothed belt with a pin mounted thereon for moving the carriage of the printer.

BACKGROUND OF THE INVENTION

The carriage having a print head thereon is generally moved by a pin on a toothed belt and which is engaged in a hole formed in the carriage.

A conventional toothed belt comprises many teeth which are formed at even intervals and a holder for rotatably holding a guide roller. The guide roller is engaged in a long and narrow hole in the carriage which in turn is slidably mounted between two parallel guide rails. When the toothed belt is moved by rotating a moving pulley, the carriage is moved along the guide rails by the moving of the guide roller as it is carried along by the belt. When the guide roller reaches the outside periphery of the pulley, the motion of the guide roller changes from a straight line to a curved motion. The guide roller moves the carriage to the end of the printing line while moving in the hole. When the guide roller moves more than 90 degrees around the pulley, the carriage is moved in the reverse direction.

In such a conventional toothed belt, the guide roller is rotatably mounted on the belt by the holder for preventing contact between the guide roller and the toothed pulleys.

The pitch line of such a toothed belt runs outward off the center axis of the guide roller. Therefore, a moment is produced at the spot where the holder is mounted on the toothed belt. This moment and load variation during printing cause the belt to vibrate. This vibration is transmitted to the carriage and causes disarray of the print. It is especially great at the position where the carriage reverses.

SUMMARY OF THE INVENTION

An object of the present invention is to provide a toothed belt which is not affected by vibration of the pin during movement.

BRIEF DESCRIPTION OF THE DRAWINGS

FIG. 1(*b*) is an exploded perspective view of the embodiment as shown in FIG. 1(*a*);

FIG. 2(*b*) is a partial perspective view of the embodiment as shown in FIG. 2(*a*);

FIG. 3(*b*) is an exploded perspective view of the embodiment as shown in FIG. 3(*a*);

FIG. 4(*b*) is an exploded perspective view of the embodiment as shown in FIG. 4(*a*);

FIG. 8(*b*) is a partial sectional view on line 8(*b*)—8(*b*) of FIG. 8(*a*);

FIG. 9(*b*) is a bottom view of the carriage of FIG. 9(*a*).

DETAILED DESCRIPTION OF THE PREFERRED EMBODIMENTS

Figure 1A:
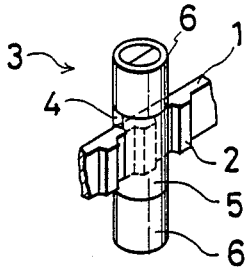
FIG. 1(*a*) is a partial perspective view of a first embodiment of the toothed belt according to the present invention.
Figure 1B:
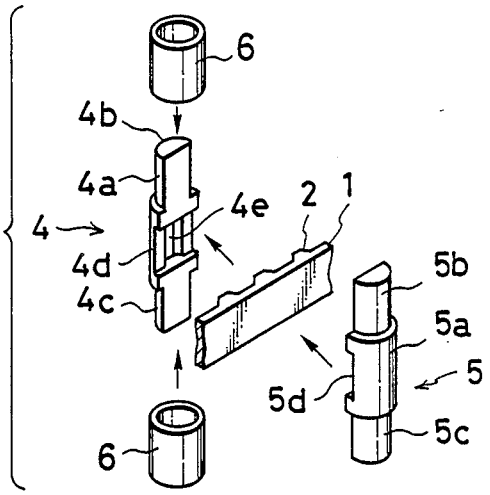

In the first embodiment of the pin as shown in FIGS. 1(*a*) and 1(*b*), teeth 2 are provided on the inside of an endless belt 1 at even intervals. The cross-section of each tooth is in the shape of a trapezoid. A pin 3 is mounted on belt 1 and comprises two pin halves 4 and 5 which engage the belt 1 from opposite sides, and two rings 6 which are placed around thin semicylindrical portions 4*b* and 4*c* on the pin halves and which project from the belt 1.

The first pin half 4 has a semicylindrical portion 4*a* and thin semicylindrical portions 4*b* and 4*c* on the opposite ends.

The second pin half 5 also has a thick semicylindrical portion 5*a* and thin semicylindrical portions 5*b* and 5*c*.

A groove 4*d* and recess 4*e* are provided on the inside face of the thick portion 4*a* of the first pin half 4. This groove 4*d* has a depth corresponding to the distance between the pitch line L of the belt 1 (see FIG. 6) and the base of the tooth 2, and a width corresponding to the width of the belt 1.

The pitch line L is the line which overlies the pitch circle of the teeth in the toothed pulleys.

The recess 4*e* is formed at the midpoint of the groove 4*d* and has a shape complementary to and with the same measurements as a tooth 2 of the belt 1.

On the inside of the thick portion 5*a* of the second pin half 5 is formed a groove 5*d* having depth corresponding to the belt thickness between the pitch line L and the outside of the belt 1 and a width corresponding to the width of the belt 1.

The axis of the pin 3 is thus positioned to correspond with the pitch line L of the belt 1.

This pin as described above is assembled with the belt as follows.

Firstly, one of the teeth 2 of the belt 1 is inserted in the recess 4*e* of the thick portion 4*a* of the first pin half 4 and the groove 5*d* of the thick portion 5*a* of the second pin half 5 is engaged over the outside of the belt 1. Secondly, rings 6 are placed onto the mated thin portions 4*b* and 5*b* and 4*c* and 5*c* projecting beyond the edges of belt 1. Lastly, the rings 6 are fixed to mated thin portions by appropriate means, such as soldering, swaging or otherwise deforming the rings over the thin portions, or by driving the point of a chisel into the joint between the rings and the mated thin portions, or other means common in the art.

Figure 2A:
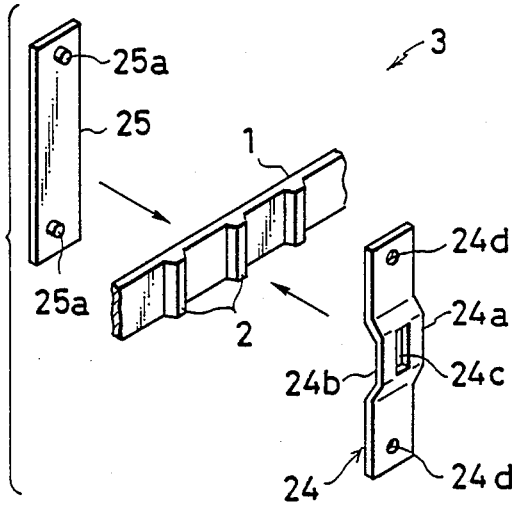
FIG. 2(*a*) is a partial exploded perspective view of a second embodiment of the toothed belt according to the invention.
Figure 2B:
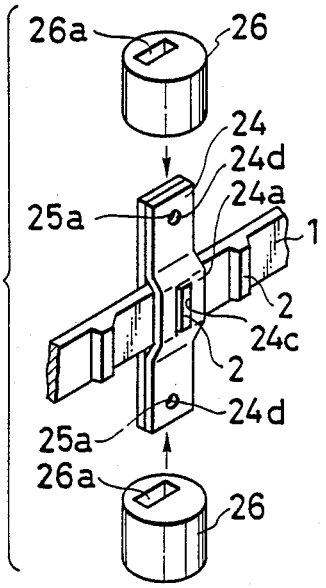

In the second embodiment of the pin as shown in FIGS. 2(*a*) and 2(*b*), the endless belt 1 and teeth 2 are the same as in Example 1.

A pin 3 comprises a first plate 24 and a second plate 25, and two cylinders 26 for holding the portions of the two plates 24 and 25 which project from the belt 1 so as to hold the plates 24 add 25 on the belt 1.

The first plate 24 has a bulge **24*a* defining a groove 24*b* corresponding in depth to the thickness of the belt 1 and corresponding in width to the width of the belt. A rectangular window 24*c* is formed in the bulge 24*a* for receiving a tooth 2. On both ends of the plate 24 are provided holes 24*d* for positioning the plate 24 on the second plate 25**.

The second plate 25 has the same length and width as the first plate 24 and has projection **25*a* on the one side at opposite ends thereof for engaging in the holes 24*d* of the plate 24**.

Each cylinder 26 has a rectangular hole **26*a* for receiving the portions of the plates 44 and 25 projecting from the belt 1 when the plates 24 and 25** are placed onto the belt.

The positions of the holes **26*a* are such that the axis of the thus formed pin 3 coincides with the pitch line L of the belt 1**.

The pin as described above is assembled with the belt as follows.

Firstly, as shown in FIG. 2(*a*), the first plate 24 is placed against the toothed side of the belt with one of the teeth 2 of the belt 1 inserted in the window **24*c* of the first plate 24, and the second plate 25 is placed against the outside of the belt with the ends against the first plate 24 and the projections 25*a* in the holes 24*d***. Secondly, as shown in FIG. 2(*b*), the holes **26*a* are placed over the projecting portions of the plates 24 and 25. Lastly, the cylinders 26 are fixed in position in the same manner as described in connection with the rings of FIGS. 1*a* and 1*b***.

Figure 3A:
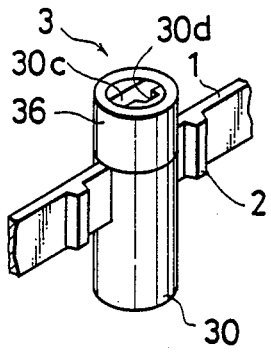
FIG. 3(*a*) is a partial perspective view of a third embodiment of the toothed belt according to the invention.
Figure 3B:
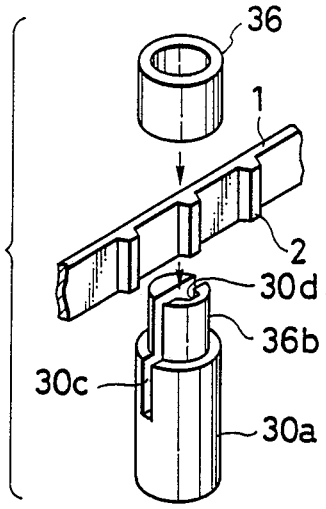

The third embodiment of the pin 3 of the present invention comprises a pin body 30 and a ring 36. The pin body 30, as shown in FIG. 3(*b*), has a large diameter portion **30*a* and a small diameter portion 30*b*. A slit 30*c* is formed in the end of the small diameter portion 30*b* and along about half of the length of the large diameter portion 30*a* on the axis of the pin 3. The depth of the slit 30*c* in the portion 30*a* is the same as the width of the belt 1. The slit 30*c* has a recess 30*d* therealong which is complementary in shape to a tooth 2 on the belt 1**.

The axis of the pin 3 coincides with the pitch line L of the belt 1.

The pin as described above is assembled with the belt as follows.

Firstly, as shown in FIG. 3(*b*), one of the teeth 2 of the belt 1 is inserted in the hollow **30*d* of the slit 30*c* through the small diameter portion 30*b* and the large diameter portion 30*a*, and belt 1 is inserted into the slit 30*c*. The ring 36 is placed over to the small diameter portion 30*b* of pin body 30. Lastly, the ring 36 is fixed in position in the same manner as described in connection with the rings of FIGS. 1*a* and 1*b***.

Figure 4A:
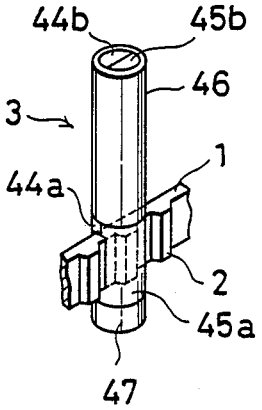
FIG. 4(*a*) is a partial perspective view of a fourth embodiment of the toothed belt according to the present invention.
Figure 4B:
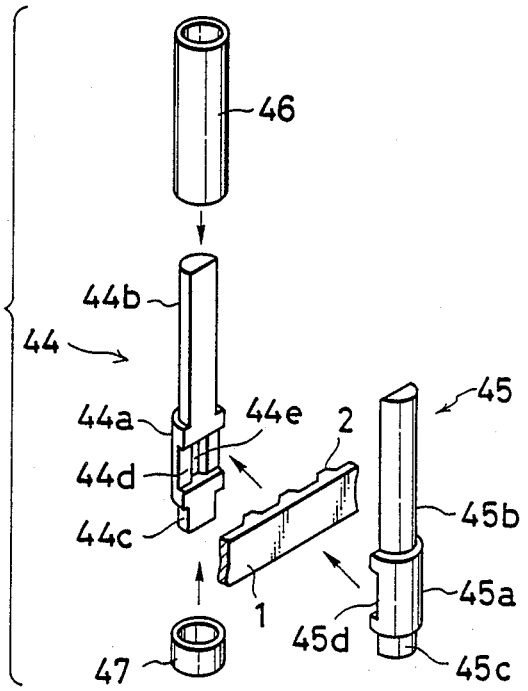

The fourth embodiment of the pin 3 as shown in FIGS. 4(*a*) and 4(*b*) comprises a first pin half 44, a second pin half 45, a long ring 46 and a short ring 47. The first pin half 44 has a large diameter semicylindrical portion **44*a* and small diameter semicylindrical portions 44*b* and 44*c* on opposite ends thereof. The second pin half 45 has a large diameter semicylindrical portion 45 and small diameter semicylindrical portions 45*b* and 45*c* on opposite ends thereof. Small diameter portions 44*b* and 45*b* are longer than other portions 44*c* and 45*c***.

The length of the portions **44*b* and 45*b* and long ring 46 is the same as the depth of a hole of a carriage 13 in which the pin is engaged. Therefore, the movement of the belt 1 is transmitted surely to the carriage 13 through the pin 3**.

A groove **44*d* and a recess 44*e* are formed on the inside of the large diameter portion 44*a* of the first pin half 44. This groove 44*d* has a depth corresponding to the distance between the pitch line L of the belt 1 and the base of the tooth 2, and a width corresponding to the width of the belt. The recess 44*e* is formed at the midpoint of the groove 44*d* and has a shape complementary to a tooth 2 on the belt 1** and is the same size.

On the inside of the large diameter portion **45*a* of the second pin half 45 is a groove 45*d* having a depth corresponding to the thickness of the belt 1 between the pitch line L and the outside of the belt 1, and a width corresponding to the width of the belt 1**.

The axis of the pin 3 coincides with the pitch line L of the belt 1.

This pin as described above is assembled with the belt as follows.

Firstly, the recess **44*e* of the large diameter portion 44*a* of the first pin half 44 is placed over a tooth 2 on the belt and the groove 45*d* of the large diameter portion 45*a* of the second pin half 45 is engaged against the outside of the belt 1. Secondly, rings 46 and 47 are put on the now mated small diameter portions 44*b* and 45*b* and 44*c* and 45*c* projecting beyond the edges of the belt 1. Lastly, the rings 46 and 47 are fixed in position in the same manner as described in connection with the rings of FIGS. 1*a* and 1*b***.

Figure 5:
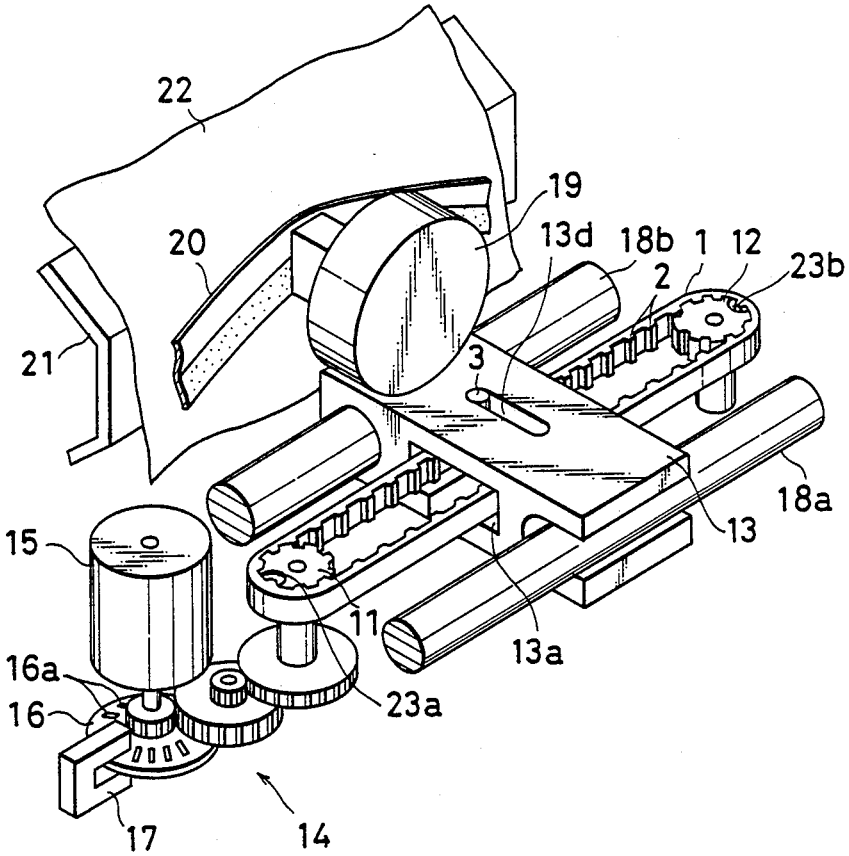
FIG. 5 is a perspective view of a part of the printer showing the belt and carriage according to the invention.

The toothed belt according to the present invention is used in a serial dot printer as shown in FIG. 5.

The belt 1 is placed around a drive pulley 11 and idler pulley 12 and the gap **13*a* in the lower part of the carriage 13 passes over the pulley shafts. The pin 3 is inserted in the elongated hole 13*d* of the carriage 13. The drive pulley 11 is connected through gear system 14 with the motor 15. A rotating plate 16 with many slits 16*a* therein is driven by the motor 15. A photo-sensor 17 senses the slits in rotating plate 16 for detecting the speed of the motor 15. The carriage 13 is moved reciprocatively along the guide rails 18*a* and 18*b*. The carriage 13 has the print head 19 mounted thereon. Reference numeral 20 designates the ink ribbon, 21 the plate and 22** the print paper.

Figure 6:
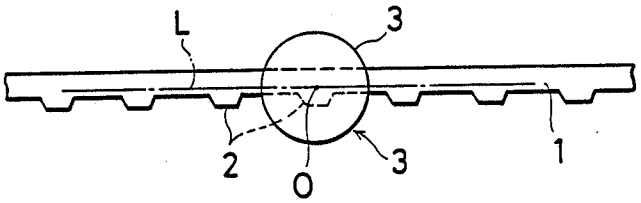
FIG. 6 is a plan view showing the relationship between the pin and the belt according to the invention.
Figure 7A:
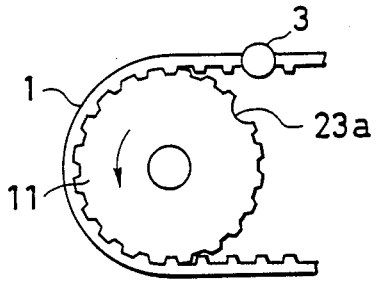
FIGS. 7(*a*)–7(*d*) are plan views showing the movement of the pin carrying part of the belt around a belt pulley.
Figure 7B:
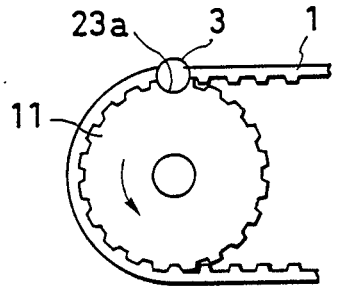
Figure 7C:
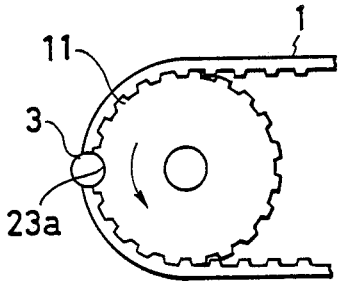
Figure 7D:
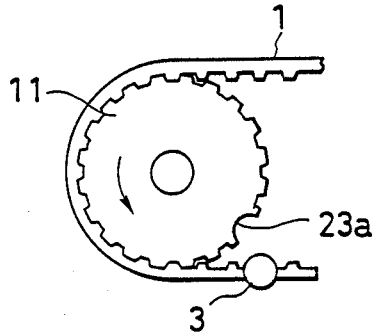

The movement of the toothed belt according to the present invention is shown in FIGS. 6 and 7.

When the pin 3 reaches to the line head or line end (FIG. 7(*a*)), one side of the pin 3 enters a pin receiving groove **23*a* in the drive pulley 11 (or pin receiving groove 23*b* in the idler pulley 12) at contact of the pin 3 with the pulley 11** (FIG. 7(*b*)).

The pin 3 and the pulley 11 rotate together (FIG. 7(*c*)) and separate (FIG. 7(*d*)).

Because the pitch line L of the belt 1 coincides with the axis 0 of the pin 3, reaction force on the pin 3 from the carriage 13 is directed along the pitch line L of the toothed belt 1. There is no moment of reaction force from the carriage 13 on the belt 1. Therefore, vibration of the toothed belt 1 does not occur. Because the carriage 13 is not affected by vibration of the toothed belt 1, the carriage 13 does not swing.

Irregular prints caused by disarrangement of dot pitch of the print head 19 which might occur at the line head or line end are avoided and clear and beautiful prints are obtained.

Because the pin of the first, second and fourth embodiments is constituted by two pin pieces and rings, it can be produced cheaply.

Figure 9A:
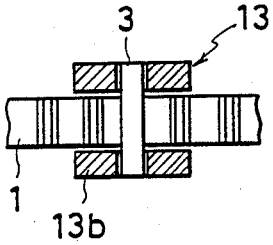
FIG. 9(*a*) is a partial sectional view similar to FIG. 8(*b*) and showing a conventional belt and carriage.
Figure 9B:
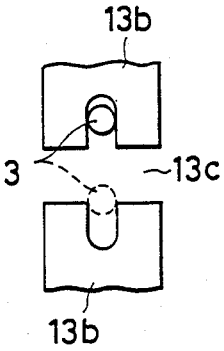

A conventional carriage has a bottom plate 13*b* as shown in FIG. 9(*a*) and a groove 13*c* for passing over the shafts of the pulleys 11 and 12, as shown in FIG. 9(*b*). This reduces the strength of the carriage 13 because of the presence of the groove 13*c*. Therefore, it is possible to cause irregular prints. Moreover, the pin 3 does not move from the one side to the other side of the hole 13*d* smoothly.

Figure 8A:
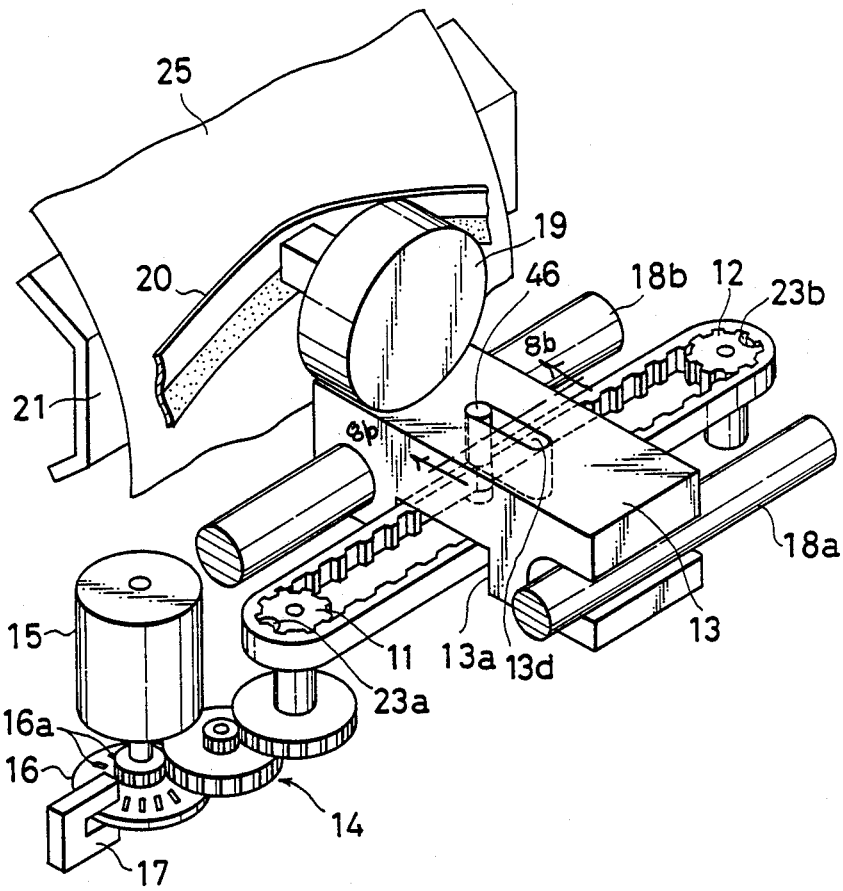
FIG. 8(*a*) is a perspective view of a part of the printer similar to FIG. 5 and showing the pin according to the embodiment of FIGS. 4(*a*) and 4(*b*) incorporated therein.
Figure 8B:
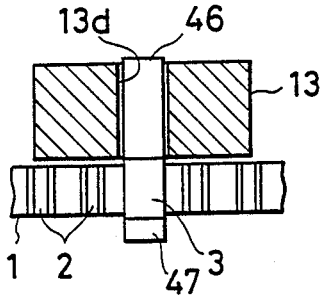

When the pin is formed according to the fourth embodiment, these conventional problems are overcome because the bottom plate 13*b* with the hole 13*a* of the carriage 13 is not necessary as shown in FIGS. 8(*a*) and 8(*b*). The sectional view of FIG. 8(*b*) shows how the upper part of frame 13 can have an increased thickness and have increased rigidity.

What is claimed is:

1. A toothed belt and pin assembly for a printer in which the pin is engaged with a guide hole of a carriage for reciprocally driving the carriage during movement of the belt, said assembly comprising an endless belt having a pitch line, and a pin mounted on said belt with the axis of the pin coinciding with the pitch line of the belt, said pin being in two abutting longitudinal halves engaged with the opposite side surfaces of said belt.

2. A toothed belt and pin assembly as claimed in claim 1 in which said pin halves each have portions on the opposite ends thereof projecting from the edges of the belt and mating with corresponding portions on the other half, and two rings, one engaged over the mating corresponding portions at each of the opposite ends of the pin halves.

3. A toothed belt and pin assembly as claimed in claim 1 in which said pin comprises a first plate having an aperture therein engaged over a tooth of said belt and ends projecting from the edges of the belt, and a second plate engaged with the opposite side of the belt and having the ends projecting from the edges of the belt and mating with the projecting ends of the first plate, and two cylinders each having an opening therethrough offset from the cylinder axis and corresponding to the cross-sectional shape of the mated ends of the plates, one cylinder fitted over the ends of the plates on one edge of the belt and the other cylinder fitted over the ends of the plates on the other edge of the belt, the cylinder axes coinciding with the pitch line of the belt.

4. A toothed belt and pin assembly as claimed in claim 1 in which said pin has a longer portion projecting from one edge of said belt and a shorter portion projecting from the other edge of said belt, and the longer portion is engaged in the guide hole, whereby the portion of the carriage in which the guide hole is formed can be made thicker so that the sole engagement between the pin and the carriage is through the guide hole.

* * * * *